US005839714A

United States Patent [19]

Fitzsimmons et al.

[11] Patent Number: 5,839,714

[45] **Date of Patent: *Nov. 24, 1998**

[54] BASKETBALL BACKBOARD SUPPORT ASSEMBLY

[75] Inventors: James N. Fitzsimmons, Waukesha; David A. Allen, Pewaukee; Randy R. Schickert, Kewaskum; Michael A. Niver, Waukesha, all of Wis.

[73] Assignee: Huffy Corporation, Miamisburg, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 612,636

[22] Filed: Nov. 22, 1995

Related U.S. Application Data

[63] Continuation of Ser. No. 56,664, May 3, 1993, abandoned, which is a continuation-in-part of Ser. No. 721,187, Jun. 26, 1991, Pat. No. 5,207,407.

[51] Int. Cl.[6] ..... F16M 13/00

[52] U.S. Cl. ..... 248/519; 248/346.06; 248/910; 473/481

[58] Field of Search ..... 248/519, 346.01, 248/346.03, 910, 520, 538; 473/481, 483, 484

[56] References Cited

U.S. PATENT DOCUMENTS

| | | | |
|---|---|---|---|
| D. 264,740 | 6/1982 | Merino et al. | D21/201 |
| 2,457,908 | 1/1949 | Meyerhoefer . | |
| 3,401,774 | 9/1968 | Krahn . | |
| 3,669,450 | 6/1972 | Mason | 273/1.5 R |
| 3,716,234 | 2/1973 | Lancellotti | 273/1.5 R |
| 3,841,631 | 10/1974 | Dolan | 273/1.5 R |
| 4,095,825 | 6/1978 | Butler | 285/55 |
| 4,145,044 | 3/1979 | Wilson et al. | 273/1.5 R |
| 4,412,679 | 11/1983 | Mahoney et al. | 273/1.5 R |
| 4,759,545 | 7/1988 | Grable | 273/1.5 R |
| 4,793,611 | 12/1988 | Thornell | 273/1.5 R |
| 5,098,092 | 3/1992 | Aakre et al. | 273/1.5 R |
| 5,207,407 | 5/1993 | Fitzsimmons et al. | 248/519 |

FOREIGN PATENT DOCUMENTS

| | | | |
|---|---|---|---|
| 2234942 | 2/1973 | Germany | 273/1.5 |
| 2920903 | 12/1980 | Germany | 273/1.5 R |

*Primary Examiner*—Ramon O. Ramirez
*Attorney, Agent, or Firm*—Michael J. Bell; Howrey & Simon

[57] ABSTRACT

A basketball assembly for supporting a backboard comprises, a base having a plurality of generally vertical side walls and a base face extending between said sidewalls. The base face and one of said side walls defining a forward edge. The assembly includes a pole, having spaced apart ends. An elongated opening is provided in the base for supporting one end of said pole on said base with said pole at an angle to the vertical to extend the other end of the pile over and beyond the forward edge of the base.

41 Claims, 7 Drawing Sheets

BASKETBALL BACKBOARD SUPPORT ASSEMBLY

This application is a continuation of application Ser. No. 08/056,664, filed on May 3, 1993 now abandoned, which is a continuation-in-part of application Ser. No. 07/721,187 filed Jun. 26, 1991 and issued as U.S. Pat. No. 5,207,407 on May 4, 1993.

BACKGROUND OF THE INVENTION

This invention relates to basketball backboard supports and, more particularly, to such supports as are portable.

Various types of basketball backboard supports have been proposed in the past. Such proposals have recognized that stability, and in some instances portability, are desirable characteristics. Obviously, stability and portability can present conflicting design considerations.

On playgrounds and at pool sides, for example, a portable backboard support is desirable. In such applications the ability to clear the support from the area, or to arrange a particular play area in a different configuration, are much sought-after attributes. This is even true to some degree in residential applications, although in those applications the supports are most commonly anchored in the ground in concrete or fixed to a structure such as a garage. Providing both stability and portability in a particular construction can also come at the price of acquiring overall a more involved structural arrangement, which means increasing complexity as well as increased cost.

In the prior art the backboard support normally includes an expensive pole usually having a diameter of three and one half inches or larger in order to provide sufficient rigidity and stability to the backboard mounted thereon. Conventional practice is to provide a pole that is inherently rigid per se to minimize waving of the backboard and pole when finally assembled. Providing a large inherenty rigid pole significantly increases material and fabrication costs. Further the use of a heavy pole makes the finished assembly less portable because it increases the weight, and heavier weight is undesirable as it increases the cost of shipping the finished product to the end user.

SUMMARY OF THE INVENTION

A need exists for a strong lightweight basketball assembly for supporting a backboard. Further a need exists for an assembly that will enable the diameter and weight of a support pole used in the assembly to be reduced while still providing a desired rigidity and stability to minimize waving of the backboard and pole.

The invention provides a basketball assembly that comprises a base having a plurality of generally vertical side walls and a base face extending between said side walls. The base face and one of the side walls define a forward edge. The assembly further includes a pole having spaced apart ends and a means for supporting one end of the pole on the base with the pole extending at an angle to the vertical to present the other end of the pole over and beyond the forward end of the base. Preferably the angle of the pole to vertical is 20° and the diameter of the pole is three inches.

Other features and advantages of the invention will become apparent to those of ordinary skill in the art upon review of the following detailed description, claims, and drawings.

DETAILED DESCRIPTION OF THE PREFERRED EMBODIMENT

Figure 1:
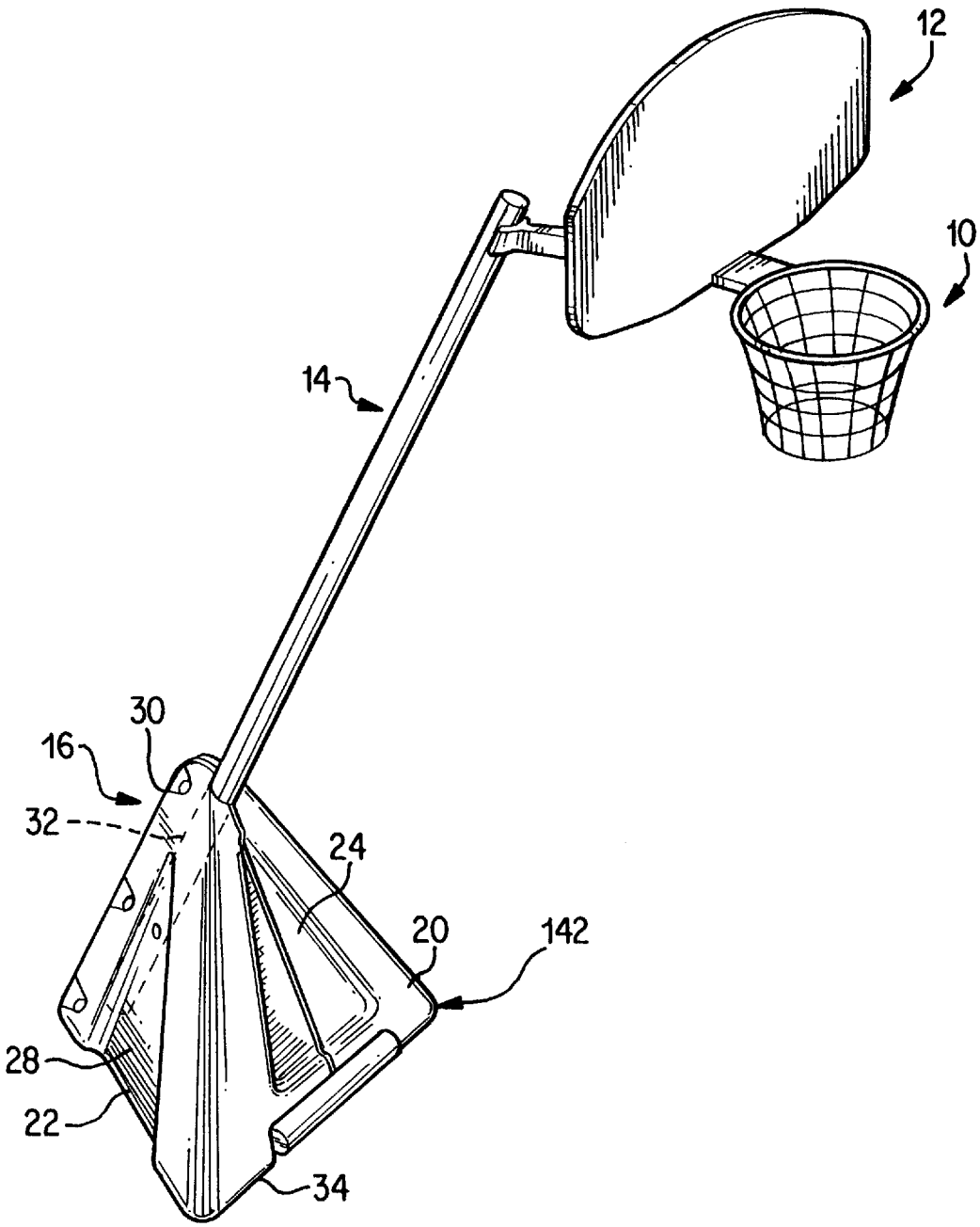
FIG. 1 is a schematic perspective view of the base of the invention in its contemplated use of supporting the pole for a basketball backboard.

FIG. 1 illustrates a basketball backboard, support pole and base, the base incorporating this invention in somewhat schematic form. Starting at the upper end, a conventional hoop and net 10 is attached to a backboard 12. A support pole 14 is suitably attached to backboard 12 in a conventional manner and extends from support base 16.

Base 16 is polyhedron shaped, the lowest side or surface forming a base face 18 contacting the ground and upon which the entire assembled unit rests. Preferably, the base 16 is made in two sections 20 and 22 and is in the form of a tetrahedron having four sides. The base can be made in one piece, but the two-piece structure possesses certain advantages which will become apparent as this discussion continues. The four sides consist of the base face 18, a front face 24 and two side faces 26 and 28. The faces 18, 24, 26, and 28 of the assembled base are all triangular in shape when the preferred tetrahedral form is used.

The sections 20 and 22 abut along a plane which includes the edge 30, along which faces 26 and 28 are joined and which plane extends generally perpendicular to base face 18. That plane preferably divides the body into two identical sections 20 and 22. The interiors of each of the sections 20 and 22 are hollow and preferably watertight. The hollow interior provides means for receiving a suitable ballast material into the sections and, thus, into the base 16. The ballast material can be water, sand, or the like, but preferably water because of its ready availability and its ease of disposal.

Figure 2:
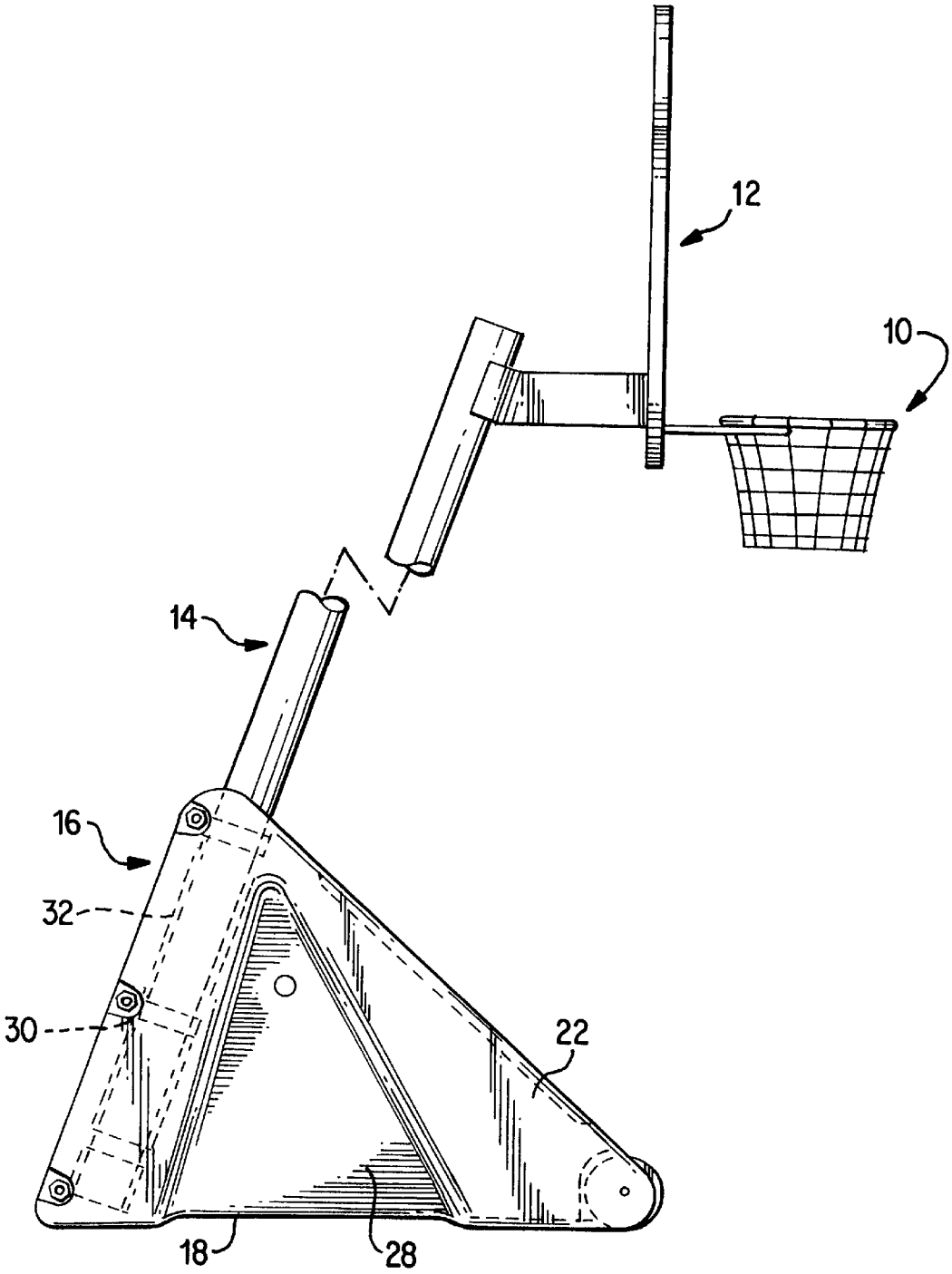
FIG. 2 is a side view of a fully assembled base.

The support pole 14 extends into the base 16 and is supported in an elongated opening or socket member 32 defined within the base (and shown by phantom lines in FIG. 2). The opening 32 is at an angle to the vertical so that when the pole 14 is inserted, it too is at an angle to the vertical. Preferably, the opening 32 extends generally parallel to the base edge 30 and has a terminal end at the top of the base 16. As will be explained more completely hereinafter, when the two sections 20 and 22 are joined, they form the opening 32 which includes means 72, 74 (FIG. 10) for securely grasping the pole 14. This means (72, 74), not shown in either FIGS. 1 or 2, is effective to hold the pole against axial movement and also against rotation.

This arrangement overall provides a stable and yet readily portable apparatus for playing basketball.

More particularly, the footprint of the base 16 is such that the pole extends out over and beyond the forward edge 34 of the base 16. This provides a stable support for holding the pole and attached basketball backboard and hoop in an upright position. The support is such that it resists any tipping of the support pole forward, in the clockwise direction in FIGS. 1 and 2, during play, and maintains the hoop in an extended position out over and away from the forward edge 34 of the base 16 for unencumbered play beneath the backboard and hoop. The use of the ballast within the separable sections 20 and 22, and thus in base 16, further increases the stability of both the base 16 and the attendant playing attachments.

Also, the pole 14 being at an angle to the vertical, although it will result in loading the pole somewhat in a bending mode, i.e., the weight of the pole, backboard, and attendant attachments tending to bend the pole 14 in a clockwise direction, it is also loaded in compression. The loading and compression is along the longitudinal axis of pole 14 and this compression loading reduces the tendency of the pole and backboard assembly to wave and enables the diameter of the pole to be reduced to a diameter of three inches while maintaining stability.

Preferably, the support means 32 and pole 14 are arranged at an angle of approximately 20° to the vertical.

A preferred structural embodiment of the base incorporating this invention is illustrated in FIGS. 3–12.

In the preferred embodiment, the sidewalls 36, 38, and 40 and the base 42 are not straight planar sections as illustrated in FIGS. 1 and 2. In the preferred embodiment seen in FIGS. 3–6, it is seen that the sidewalls, although maintaining the triangular shape, are somewhat indented. The indented configuration is desired for aesthetics and to lend rigidity to the sidewalls and base. The indentation provides recessed surfaces 44 and 46, an additional recessed surface 47 on the remaining side face not shown in FIG. 3. These surfaces are joined to the principal planar faces of the triangular sidewalls by a series of smaller walls, 48 and 50 with respect to side face 44, and 52 and 54 with respect to forward face 46. An arrangement similar to that on recess 44 is provided on side face 47 not visible in FIG. 3. The recesses provide aesthetic features as well as improving the mechanical strength of the sidewalls. The bottom or resting face 55, again not visible in FIG. 3, also has recesses.

Figure 4:
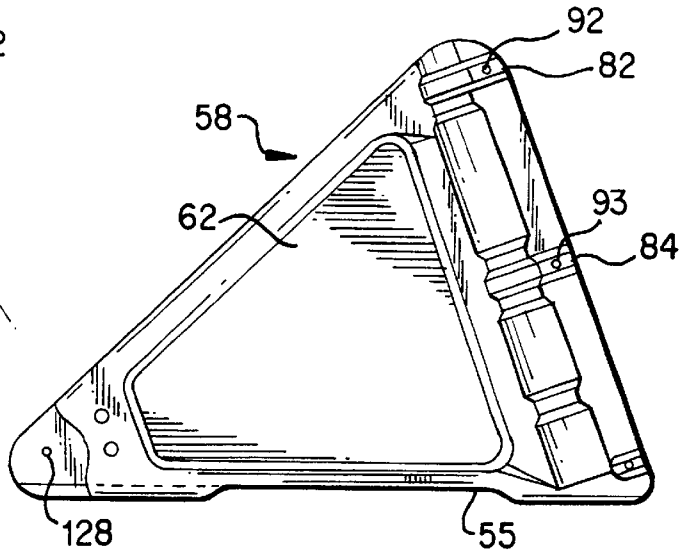
FIG. 4 is a side view of the base, viewing the inside surface of an unassembled base section.
Figure 5:
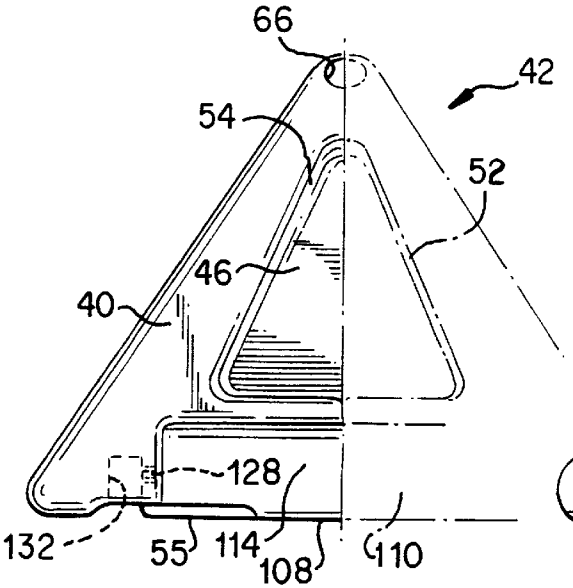
FIG. 5 is a front view of the base section of FIG. 4 with broken lines disclosing the roller attachment area.
Figure 6:
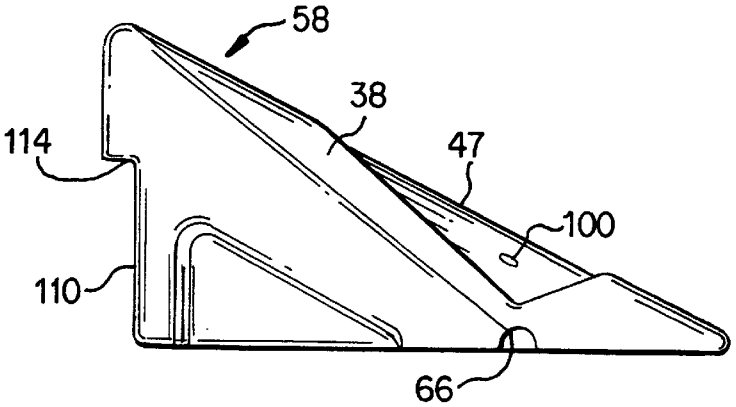
FIG. 6 is a top view of base section of FIG. 4.

The actual base is formed by two separable sections 56 and 58 which, in the preferred embodiment, are identical mirror images of one another (FIGS. 4–6). Sections 56 and 58 include inner walls 60 and 62 which are in a plane which is generally perpendicular to the triangular face forming the base, and extend through the edge 64 along which triangular faces 44 and 47 are joined.

Figure 7:
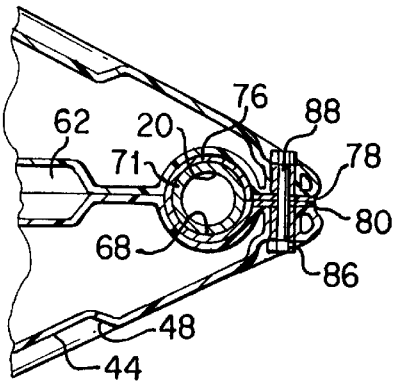
FIG. 7 is a view of the area of pole attachment showing the workings of the clamp assembly, viewed along line 7—7 of FIG. 3.
Figure 3:
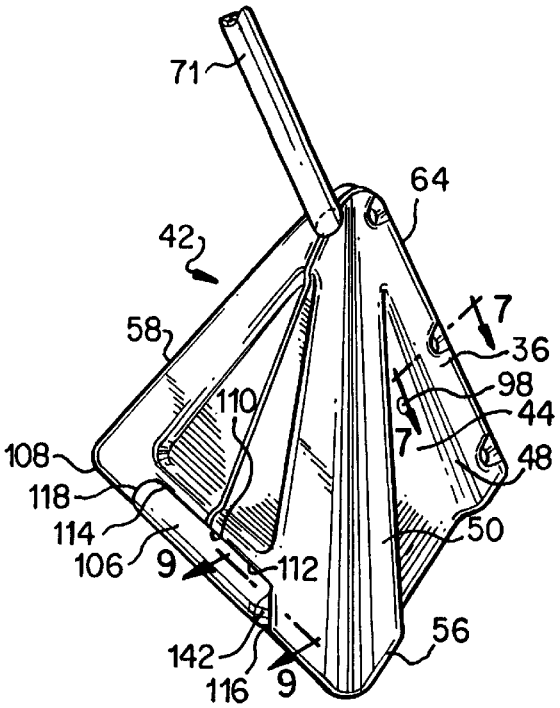
FIG. 3 is a perspective view of an assembled base.

With reference to FIG. 7, the elongated opening 66 is formed in the base by two mating surfaces, one on section 56 and one on section 58. These mating surfaces 68 and 70 are semi-circular in cross section and are arranged with their axes parallel to edge 64 such that when sections 56 and 58 are brought together, they define an elongated tubular opening (see FIG. 4) extending parallel to edge 64. Pole 71 can be received in the opening defined by the two sections 68 and 70 when they are suitably joined in abutting relationship.

Figure 8:
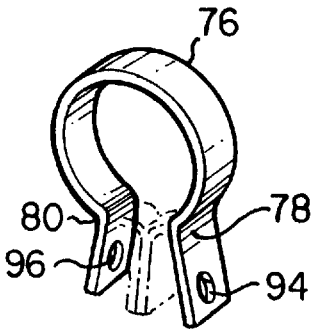
FIG. 8 is a perspective view of the pole clamp.
Figure 12:
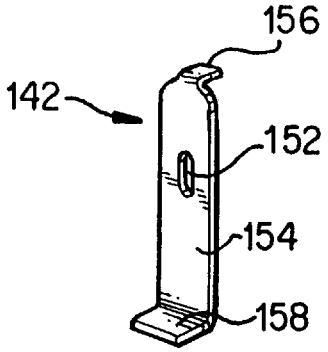
FIG. 12 is a perspective view of the locking clip.

With respect to joining the separable sections 56 and 58, two clamps 72 and 74 are provided. One such clamp is shown in FIG. 8 separated from the base. The clamp is made of spring material, preferably rolled steel, and has a generally circular body 76 and two radially extending arms 78 and 80 at the ends of body 76. The normal configuration of a clamp is illustrated by the full lines in FIG. 8. When the sections 56 and 58 are to be joined together, one clamp 72 is placed in area 82 and the other in area 84 and as the sections are brought together, the arms 78 and 80 are moved to the dotted line position shown in FIG. 8. The pole 71 will have been (FIG. 10) previously positioned in the body 76 of a clamp so that as the sections 56 and 58 are brought together and arms 78 and 80 are correspondingly brought together, the area circumscribed by body 76 is reduced and firmly clamps around the pole. When the two 56 and 58 sections are in their final position, i.e., their final assembled position, a suitable nut 86 and 87 and bolt 88 and 89 arrangement is inserted through openings 90, 91, 92 and 93 in sections 56 and 58 and through openings 94 and 96 in the closed arms 78 and 80, and both the base sections 56 and 58 and the clamp arms 78 and 80 are secured in position, holding the pole 71 in the desired orientation.

Fill holes 98 and 100 (FIGS. 3 and 6) are provided in sidewalls 102 and 104 of sections 56 and 58. These holes provide the means through which the ballast can be introduced into the interior of sections 56 and 58. It will be noted from the drawings that the interior of both sections 56 and 58 are hollow, forming compartments which generally follow the configuration of the tetrahedron base.

With the ballast in place, the base, backboard, and hoop are ready for play.

Figure 11:
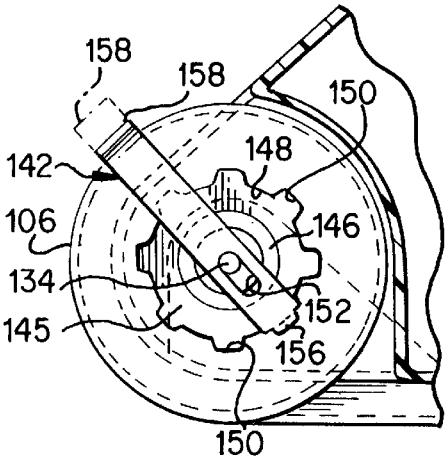
FIG. 11 is a view of the roller locking clip and assembly taken along view 11—11 of FIG. 9 and demonstrating the locking action.
Figure 9:
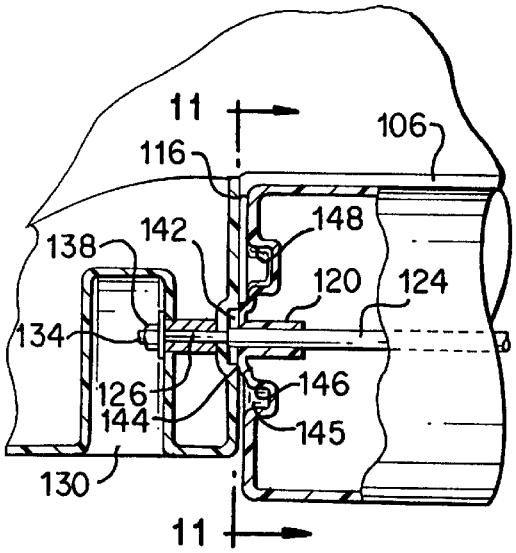
FIG. 9 is a view taken along line 9—9 of FIG. 3 showing the attachment of the roller to the base.
Figure 10:
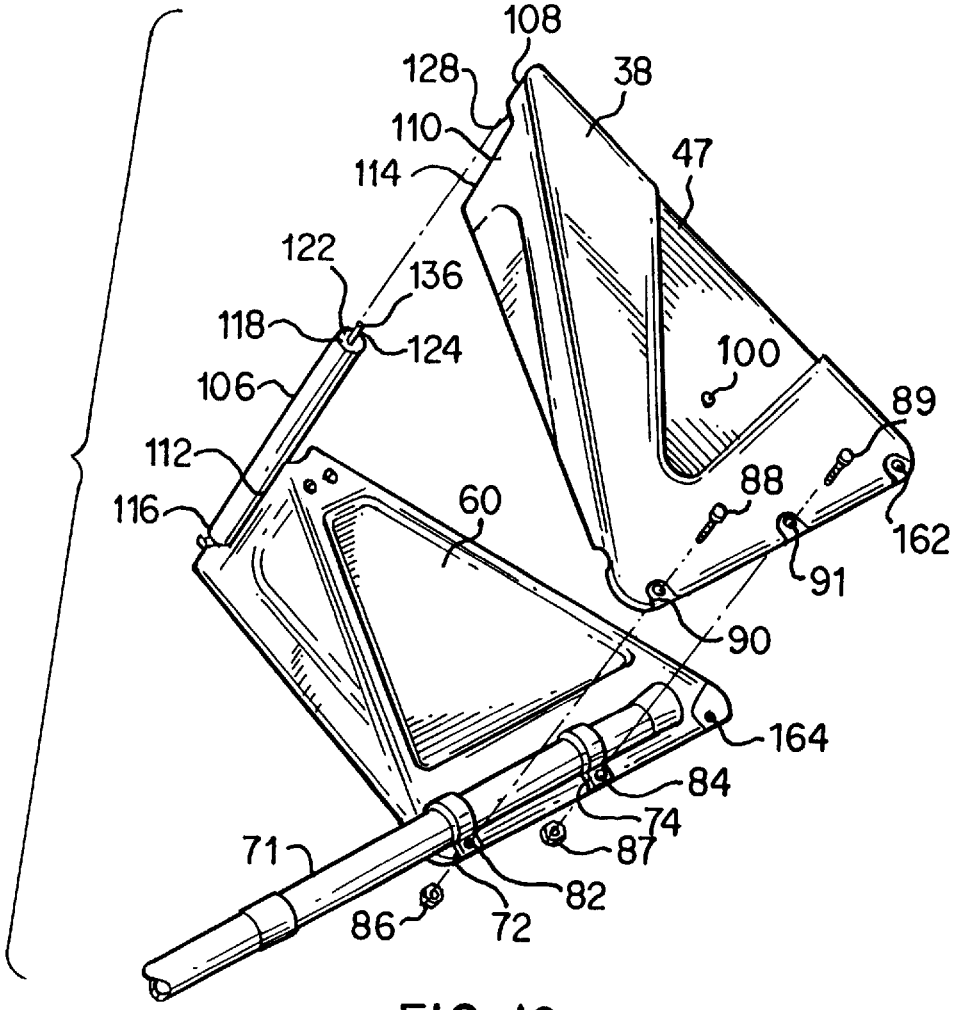
FIG. 10 is a perspective view demonstrating the mode of assembly of the roller.

If desired, a roller 106 can be included in base 42, along forward edge 108 where forward face 46 and resting face 55 meet. A recessed portion 110 in forward edge 108 is provided, formed by adjacent recessed portions 112 and 114 of sections 56 and 58. The roller 106, as seen in FIG. 9, is generally cylindrical and hollow, with opposite ends 116 and 118. Ends 116 and 118 have small openings 120 and 122 (FIGS. 9–11). An axle 124 extends through both openings and through small openings 126 and 128 located (FIGS. 5 and 9) at the ends of the recessed portions 112 and 114. The separable sections 56 and 58 also have (FIGS. 5 and 9) small indentations 130 and 132 which push up from the bottom of the base 55 and provides a space for affixing the axle ends 134 and 136 and securing the axle in place. Small nuts are used to affix to the threaded axle ends, FIG. 9 depicting such an arrangement with axle end 134 and nut 138.

In assembling the roller (FIG. 10) the base is laid on the ground and roller axle 124 is passed through hole 126 in recess 112 of separable section 56, and secured within indentation 130 by nut 138 onto threaded axle end 134. A locking clip 142 is placed over the axle and slid down until it lodges in a molded depression 144 about hole 126. The roller 106 is then passed over axle 124, threading axle 124 through the holes 120 and 122 at the roller ends 116 and 118. Before assembling section 58 towards section 56, a second locking clip (not depicted) can optionally be fitted over axle end 136 and which would rest against roller end 118 until section 58 is brought down.

As seen in FIGS. 9 and 11, the roller ends each have a unique configuration, end 116 depicted with a depression 145 encircling opening 122. (The opposite end 118 of roller 106 is similar and is not depicted in detail). Depression 145 has a smooth inner wall 146 towards the roller axis, and an outer wall 148 which has regularly repeating outpocketings 150, wherein the distance from inner wall 146 is increased for a certain circumferential distance. This gives outer wall 148 a toothed or sprocketed appearance (FIG. 11).

Locking clip 142 has an offset hole 152 which is positioned over axle 124 in assembly (FIG. 11). The clip 142 (FIG. 12) has a longitudinal axis with a flat strip portion 154, preferably of hardened steel. It also has ends 156 and 158, which are additionally bent perpendicular to the plane of the flat strip portion 154, with one bent end 156 reduced in width. The clip 142 is positioned (FIG. 11) over axle 124 so that the reduced end 156 falls within depression 145 in end 116.

As section 58 is placed over section 56, threaded axle end 136 passes through hole 128 in recessed portion 114, and is fixed within indentation 132 by a nut (not depicted). Molded depression 144 (FIG. 9) about opening 126 in recess portion 112 now firmly fixes the strip portion 154 of the clip 142. Roller end 116 holds clip 142 against depression 144. Clip 142 is movable relative to depression 144 along its longitudinal axis, but is held by depression 144 against rotational movement about roller axis 124.

Hole 152 in clip 142 is elongated, and permits (FIG. 11) the relative longitudinal movement of locking clip 142 within depression 145. In the locking position, indicated by solid lines in FIG. 11, the small bent end 156 of clip 142 occupies one of the outpocketings 150 of depression 145 of roller end 116, and holds roller 106 against rotation about axle 124. Pulling the pin out to the position indicated by dotted lines in FIG. 11 pulls the small bent end 156 out of the previously occupied outpocketing 152 and into the main body of depression 145. In this position, clip 142 does not oppose rotation of roller 106 about axle 124.

In this way, roller 106 is supported at the broad forward edge 108 of the base over which the basketball support pole 71 extends, and the roller assembly itself assists in holding the two separate sections 56 and 58 together. Placing the roller along the broad edge 108, over which the basketball pole 71 and backboard and hoop extend, contributes to the ease of moving the entire assembly by means of the roller.

A pair of aligned openings 162 and 164 are provided (FIG. 10) in base sections 56 and 58 near the bottom of joined edge 64. A suitable nut and bolt arrangement can be used here to affix a stake, chain or other suitable means (not shown) for securing the back end of base 42 against movement.

Figure 13:
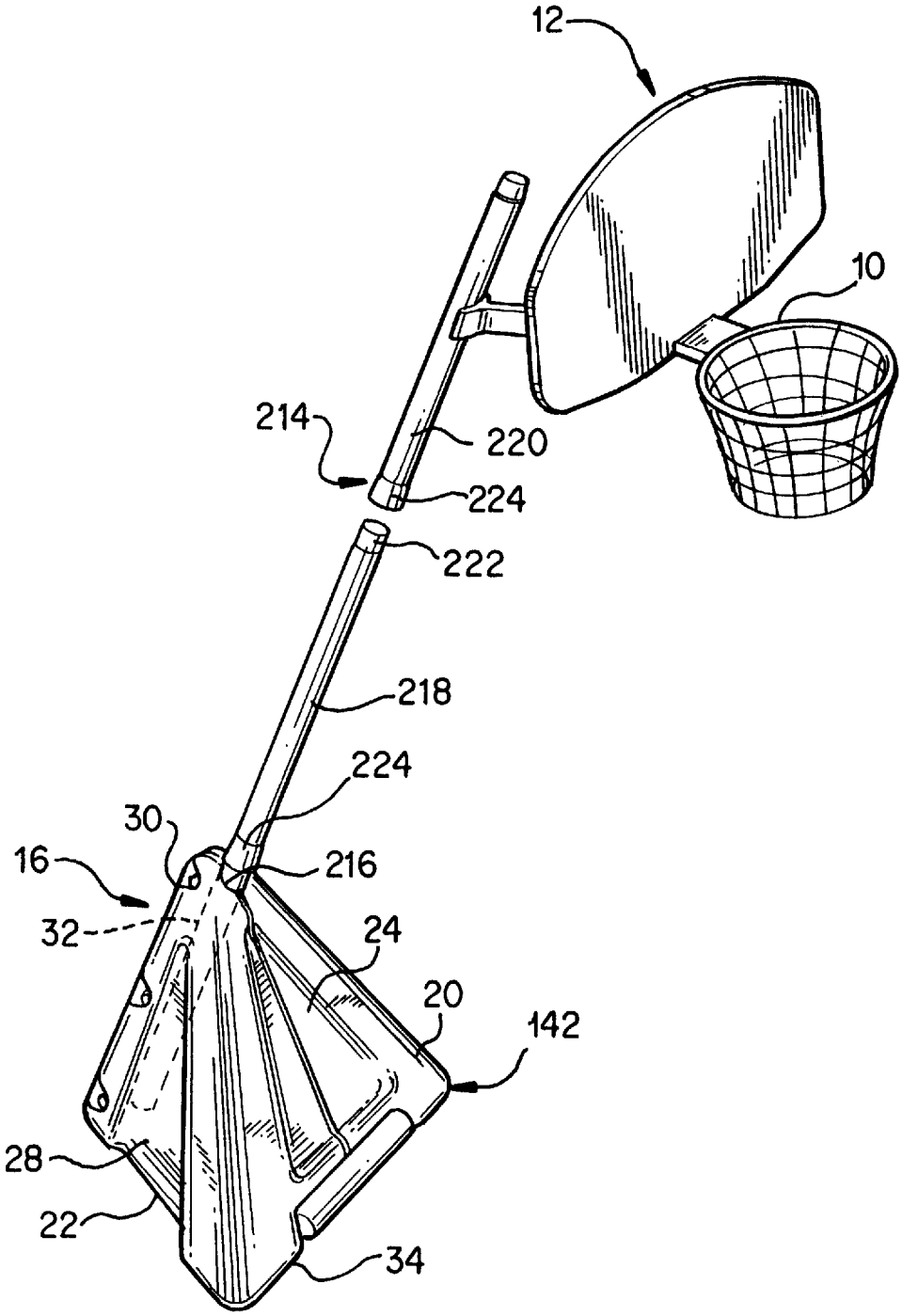
FIG. 13 is a schematic perspective view of the base similar to FIG. 1 but shown supporting a sectionalized pole for a basketball backboard.
Figure 14:
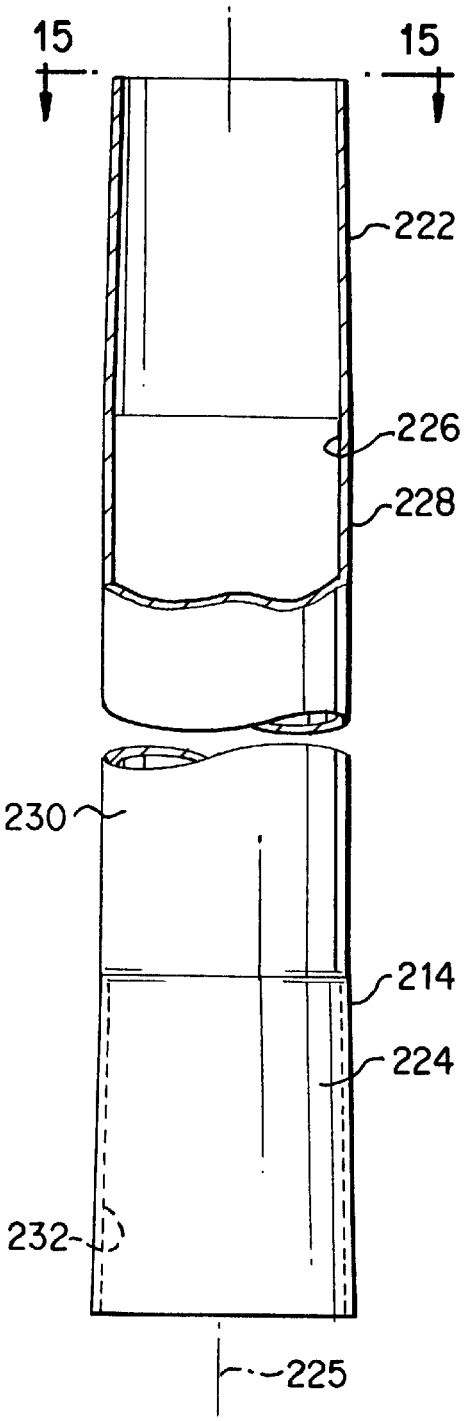
FIG. 14 is a side view of a portion of the sectionalized pole shown in FIG. 13, partially in section.

FIGS. 13–16 show a sectionalized pole 214 which can be used instead of the one piece pole 14 shown in FIG. 1. The support base 16 shown in FIG. 13 is of the same construction as previously described with respect to FIGS. 1–12 and no further explanation of base 16 is required.

The support pole 214 includes three like-dimensioned components, a bottom section 216, a middle section 218 and a top section 220. A greater or lesser number of sections could be used. Each section is identically configured at least as to their opposite ends and preferably as to length as well. Each section has a reduced end 222 and an expanded end 224. As the reduced and expanded ends 222 and 224 of all sections are identical only one set of ends 222, 224 will be described.

The reduction and expansion of each end is uniform relative to the longitudinal axis 225 of the pole 214. The expanded end 224 flares or angles uniformly outwardly relative to the axis 225 and the reduced end 222 flares or angles uniformly inwardly relative to axis 225 at identical degrees of taper preferably less than one degree.

Figure 15:
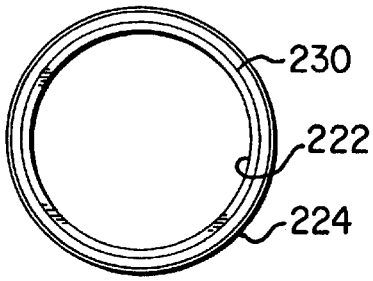
FIG. 15 is a top view taken along line 15—15 of FIG. 14.

As shown in FIG. 15 each section is preferably a hollow tube of circular cross section with a standard intermediate portion 230 between the ends 222, 224 that has an inner wall 226 and outer wall 228. The tube could be of other cross sectional configuration provided that the socket 32 in the base 16 is suitably configured to receive the tube 230 therein.

Figure 16:
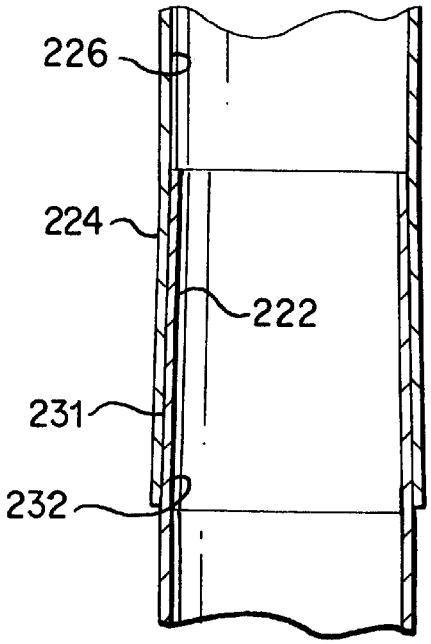
FIG. 16 is a sectional view of the self-holding connection between joined sections of the pole shown in FIG. 13.

FIG. 16 shows the connection formed between the ends 222 and 224. The overall degree of taper of the ends creates a snug frictional wedge fit between the outer surface 231 of reduced end 222 and the inner surface 232 of the expanded end 224. The connection thus formed is self-holding and separable when it is desired to disassemble the pole 214.

In assembly, as the sections 216, 218 and 220 are identical, any section can be used as the bottom section 216 and secured in socket 32 of base 16. Simiarily any section can be used as the middle section 218 and the top section 220. As shown the bottom section is placed to have its expanded end 224 positioned downward so that the flare of each succeeding expanded end 224 will overlap the reduced end 222 to direct water away from the connection between the sections.

Although but one embodiment of the present invention has been illustrated and described, it will be apparent to those skilled in the art that various changes and modifications may be made therein without departing from the spirit of the invention or from the scope of the appended claims.

It is claimed:

1. A basketball assembly comprising, in combination, a base having a plurality of generally vertical side walls and a base face extending between said sidewalls, and said base face and one of said side walls defining a forward edge, said base also including a ballast receiving portion, a pole having spaced apart ends, and means for supporting one end of said pole on said base with said pole extending at an angle to the vertical in overlapping relationship with said base face and with the other end extending over and beyond said forward edge.

2. The basketball assembly of claim 1, wherein said base has a generally hollow interior defining a cavity to provide said ballast receiving portion.

3. The basketball assembly of claim 1, wherein said base also comprises roller means rotatably mounted proximal said forward edge.

4. The basketball assembly of claim 4, wherein said forward edge comprises a recessed portion and said roller means is rotatably mounted in said recessed portion.

5. The basketball assembly of claim 1, wherein the angle of said pole to vertical is approximately 20°.

6. The basketball assembly of claim 1, wherein the diameter of said pole is approximately three inches.

7. The basketball assembly of claim 1, wherein said pole comprises a plurality of pole sections releasably connected together.

8. A basketball assembly comprising, in combination, a base having a plurality of generally vertical sidewalls and a base face extending between said sidewalls, said base face and one of said sidewalls defining a forward edge, a pole having spaced apart ends and means for supporting one end of said pole on said base with said pole extending at an angle to the vertical with the other end extending over and beyond said forward edge, wherein said means for supporting said pole includes a support extending from said forward edge toward said pole and being connected to said pole between the ends of said pole.

9. The basketball assembly of claim 3, wherein said support forms a support brace lying in a plane which is generally perpendicular to said base face.

10. The basketball assembly of claim 8, wherein said base has a generally tetrahedron body shape.

11. The basketball assembly of claim 8, wherein said base is formed of two separable parts.

12. A basketball assembly comprising:

a base having a forward edge, and a pole having two ends, one of said ends removably attached to said base, substantially remote from said forward edge, by a support member, said pole extending at an angle to the vertical in overlapping relationship with said base, and with said pole extending over and beyond said forward edge.

13. The basketball assembly of claim 12, wherein said support member comprises a socket for receiving said one end of said pole, and said one end is releasably attachable to said socket by a connecting member disposed between said pole and said base.

14. The basketball assembly of claim 13, wherein said socket encircles said one end of said pole.

15. The basketball assembly of claim 12, wherein said pole includes a portion between said ends and further comprising a second support member connecting said base to said portion of said pole.

16. The basketball assembly of claim 15, wherein said second support member is disposed at least partially forward of said pole.

17. The basketball assembly of claim 15, wherein said connecting member comprises a metal clamp.

18. The basketball assembly of claim 12, wherein the angle of said pole to vertical is approximately 20°.

19. The basketball assembly of claim 12 wherein the diameter of said pole is approximately three inches.

20. The basketball assembly of claim 12, wherein said base also comprises a roller rotatably mounted proximal said forward edge.

21. The basketball assembly of claim 12, wherein said base includes a ballast receiving portion.

22. A basketball assembly comprising:

a hollow base having a forward edge and a cavity for receiving ballast, and a pole having two ends, one end being attachable to said base at a point substantially remote from said forward edge with said pole extending at an angle to the vertical, and with said pole being in overlapping relationship with said base and extending over and beyond said forward edge.

23. A basketball assembly according to claim 22, wherein said hollow base comprises a tetrahedron shaped body.

24. A basketball assembly according to claim 22, wherein said hollow base comprises a plurality of walls angularly positioned with respect to each other and forming a tetrahedron-shaped body having a triangular base and three triangular sidewalls;

the tetrahedron-shaped body including a first separable section and a second separable section, each separable section including a plurality of walls angularly positioned with respect to each other, and further comprising:

means for joining the first separable section and the second separable section together to form said tetrahedron body.

25. A basketball assembly according to claim 24, further comprising:

support means within said tetrahedron body defining an elongated opening extending into said body for receiving a support pole with an elongated axis, said support means including a first portion attached to the first separable section and a second portion attached to the second separable section, the first portion and the second portion cooperating, when the two separable sections are joined, to provide secure connection of said pole into said base; and means for securing said pole in said elongated opening against rotation about the elongated axis and against withdrawal from the opening.

26. A basketball assembly as claimed in claim 25, wherein the first separable section includes a first recess positioned along a base edge opposite said first support means portion and the second separable section includes a second recess positioned along a base edge opposite said second support means portion and further wherein the first recess and the second recess form a gap when the first separable section and the second separable section are joined; and further comprising: means for rolling said base; and means for attaching said rolling means to said base within the gap.

27. A basketball assembly according to claim 25, wherein the elongated opening is arranged at an angle to the vertical and extends generally parallel to one of the edges along which the triangular shaped side walls are joined.

28. A basketball assembly according to claim 27, wherein said opening is arranged at approximately 20 degrees to the vertical.

29. A basketball assembly according to claim 22, wherein said hollow base comprises a polyhedron shaped body.

30. A basketball assembly according to claim 22, further comprising: a plurality of walls angularly positioned with respect to each other and forming a polyhedron-shaped body, the polyhedron-shaped body including a first separable section and a second separable section, each separable section including a plurality of walls angularly positioned with respect to each other;

means for joining the first separable section and the second separable section together to form the polyhedron-shaped body; and support means within the polyhedron-shaped body defining an elongated opening extending into the body at an angle to the vertical and for receiving a support pole with an elongated axis, said support means including a first portion attached to the first separable section and a second portion attached to the second separable section, the first portion and the second portion forming a secure connection of said pole into said base opening against rotation about the elongated axis and against withdrawal from the opening when the first separable section and the second separable section are joined.

31. A basketball assembly for supporting a basketball backboard, comprising, in combination, a base having a back end portion and a forward edge spaced from said back end portion;

a pole having an upper end portion a middle, and a lower end portion; and means for supporting said pole lower end portion directly on said base proximate said back end portion to extend upward therefrom at an angle to vertical with said middle and upper end portions of said pole in overlapping relationship with said base and extending beyond said forward edge.

32. The basketball assembly of claim 31, wherein said support means comprises a tubular socket member on said back end portion extending at an angle to vertical, said socket member has an upper terminal end portion in which said pole lower end portion is mounted, and said support means further comprises a support brace extending between said forward edge and said tubular socket member.

33. The basketball assembly of claim 32, wherein said base has a generally tetrahedron body shape.

34. The basketball assembly of claim 32, wherein said base is formed of two separable parts.

35. A basketball assembly comprising:

a hollow base having a forward edge and a cavity for receiving ballast, said hollow base comprising a tetrahedron shaped body, and a pole having two ends, one end being attachable to said base, substantially remote from said forward edge, with said pole extending at an angle to the vertical, and with said pole being in overlapping relationship with said base and extending over and beyond said forward edge.

36. A basketball assembly according to claim 35, wherein said hollow base comprises a plurality of walls angularly positioned with respect to each other and forming a tetrahedron-shaped body having a triangular base and three triangular sidewalls;

the tetrahedron-shaped body including a first separable section and a second separable section including a plurality of walls angularly positioned with respect to each other, and further comprising:

means for joining the first separable section and the second separable section together to form said tetrahedron body.

37. A basketball assembly according to claim 36, further comprising:

support means within said tetrahedron body defining an elongated opening extending into said body for receiving a support pole with an elongated axis, said support means including a first portion attached to the first separable section and a second portion attached to the second separable section, the first portion and the second portion cooperating, when the two separable sections are joined, to provide secure connection of said pole into said base; and means for securing said pole in said elongated opening against rotation about the elongated axis and against withdrawal from the opening.

38. A basketball assembly according to claim 37, wherein the elongated opening is arranged at an angle to the vertical and extends generally parallel to one of the edges along which the triangular shaped side walls are joined.

39. A basketball assembly according to claim 38, wherein said opening is arranged at approximately 20 degrees to the vertical.

40. A basketball assembly according to claim 35, further comprising: a plurality of walls angularly positioned with respect to each other and forming a polyhedron-shaped body, the polyhedron shaped body including a first separable section and a second separable section, each separable section including a plurality of walls angularly positioned with respect to each other;

means for joining the first separable section and the second separable section together to form the polyhedron-shaped body; and support means within the polyhedron-shaped body defining an elongated opening extending into the body at an angle to the vertical and for receiving a support pole with an elongated axis, said support means including a first portion attached to the first separable section and a second portion attached to the second separable section, the first portion and the second portion forming a secure connection of said pole into said base opening against rotation about the elongated axis and against withdrawal from the opening when the first separable section and the second separable section are joined.

41. A basketball assembly as claimed in claim 40, wherein the first separable section includes a first recess positioned along a base edge opposite said first support means portion and the second separable section includes a second recess positioned along a base edge opposite said second support means portion and further wherein the first recess and the second recess form a gap when the first separable section and the second separable section are joined; and further comprising: means for rolling said base; and means for attaching said rolling means to said base within the gap.

* * * * *